United States Patent [19]

Usami

[11] 4,222,137

[45] Sep. 16, 1980

[54] INTERNAL PRESSURE ADJUSTABLE BED

[75] Inventor: Nobuo Usami, Tokyo, Japan

[73] Assignee: Nihon Bed Manufacturing Company, Ltd., Tokyo, Japan

[21] Appl. No.: 1,348

[22] Filed: Jan. 5, 1979

[30] Foreign Application Priority Data

| | | | |
|---|---|---|---|
| Mar. 20, 1978 | [JP] | Japan | 53-30954 |
| Mar. 20, 1978 | [JP] | Japan | 53-34566[U] |
| Jun. 6, 1978 | [JP] | Japan | 53-67237 |
| Aug. 4, 1978 | [JP] | Japan | 53-94544 |

[51] Int. Cl.[2] ..... A47C 23/04

[52] U.S. Cl. ..... 5/446; 5/DIG. 2; 5/475

[58] Field of Search ..... 5/DIG. 2, 446, 447, 5/475

[56] References Cited

U.S. PATENT DOCUMENTS

| | | | |
|---|---|---|---|
| 2,773,270 | 12/1956 | Rozelle | 5/DIG. 2 |
| 3,739,409 | 6/1973 | Johnson | 5/447 |

FOREIGN PATENT DOCUMENTS

| | | | |
|---|---|---|---|
| 709755 | 5/1965 | Canada | 5/446 |

*Primary Examiner*—Casmir A. Nunberg

*Attorney, Agent, or Firm*—Jordan and Hamburg

[57] ABSTRACT

A bed adjustable in hardness distribution of its surface. An elastic member is interposed between a surface side member and a bottom plate of the bed, and the bottom plate is divided in the direction of its plane and each of the bottom plates thus divided is made vertically adjustable to allow the internal pressure of the said elastic member to be changed, so that the internal pressure of each part against the urging force from the surface is changed and the depression amount of the bed surface becomes uniform.

10 Claims, 11 Drawing Figures

INTERNAL PRESSURE ADJUSTABLE BED

BACKGROUND OF INVENTION

This invention relates to an internal pressure adjustable bed which is concerned with the art of internal pressure adjustment for beds and which belongs to the bed of International Patent Classification A47C.

Generally in many beds, the internal pressure of a mattress mounted thereon, namely the hardness of the mattress surface, is uniform throughout the surface. However, a human body lying on the mattress gives different loads in the head, breast, hip and leg, so if the internal stress of all portions of the mattress is constant, there occur differences in the depression amount among such portions of the human body. To give a proper amount of elasticity to the mattress surface to thereby improve comfortableness, a large number of coiled springs are mounted upright and close together between the upper and the lower face of the mattress, or an elastic material such as a foamed synthetic resin is interposed therebetween. However, this is disadvantageous in that a human body lying on the mattress is depressed in the form of V letter because usually the hip gives the largest load. Thus, in conventional beds it has been impossible to obtain such a sleeping posture as is considered desirable from the standpoint of health. In an attempt to remedy this drawback there has been proposed a method in which springs or elastic materials are interposed between the upper and the lower face of a mattress so as to be different in internal stress beforehand in various positions, and the elastic modulus of average positions on which large loads are placed is made large. In another method proposed, springs or elastic materials which are homogeneous or same are mounted within a mattress and the lower face of such springs or elastic materials is supported by a pre-curved bottom plate, so that the amount of displacement of the springs or elastic materials is changed and the internal stress changed to the direction of the plane of the mattress.

In such a fixed typed bed, a human body, if it matches a designed physical constitution, will of course be borne horizontally on the bed, but when a person whose physical constitution is different from an average physical constitution, e.g. a child, uses the bed, his feeling in bed will become worse because of inequality in hardness of the mattress surface, and thus it is impossible for users with different physical constitutions to always enjoy a good feeling of use. Beds of this sort are further disadvantageous in that, when they are used for many years, springs or elastic materials will deteriorate resulting in depression of the mattress surface, and that usually such deterioration occurs biasedly with respect to the mattress surface. Means for its correction has not been available, so a bed which eliminates all of the above drawbacks has been desired.

SUMMARY OF INVENTION

In view of the desire mentioned above, this invention aims at providing a bed capable of changing the stress of various portions of the mattress surface in accordance with the physical constitution of the user.

It is another object of the invention to provide a bed capable of bearing a human body horizontally on its mattress by utilization of the difference in internal stress of springs or elastic materials which are adjusted according to the physical constitution of the user.

It is a further object of the invention to provide a bed which gives a good feeling of use.

It is an additional object of the invention to provide various lifting mechanisms to raise and lower the bottom plate of the mattress of a bed as means for changing the internal stress in various positions of the above-mentioned springs or elastic materials.

In order to achieve the aforesaid objects, the present invention provides a bed of a construction such that a bottom plate is interposed between the upper and the lower face of the mattress of the bed, the said bottom plate is suitably divided in the direction of its plane, each of the bottom plates thus divided is made vertically adjustable with respect to the lower face of the mattress, and the lower ends of springs which are mounted upright and close together between the upper face of the mattress and the bottom plates, or of elastic materials interposed therebetween, are displaced respectively.

Furthermore, the present invention provides various lifting mechanisms as means for raising and lowering the above-mentioned bottom plates, including a lifting mechanism which utilizes the action of a threaded engagement, a lifting mechanism which utilizes the cam action and a lifting mechanism which utilizes the pantograph effect.

The present invention has been summarized above, but the foregoing and further objects and novel features of the invention will become apparent more fully from the following detailed description when the same is read in connection with the accompanying drawings. It is to be understood, however, that the drawings are more limited embodiments for illustration only and are not intended to restrict the scope of the invention.

DESCRIPTION OF PREFERRED EMBODIMENTS

Figure 1:
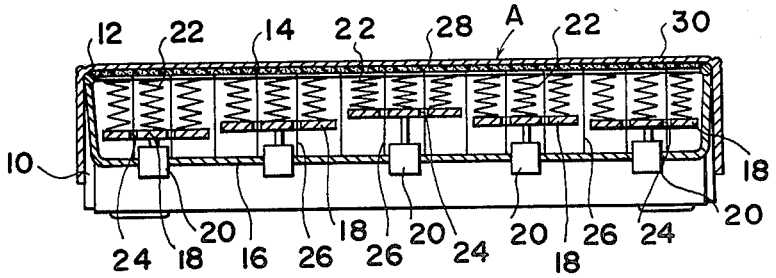
FIG. 1 is a schematic longitudinal section of a bed showing the principle of the present invention.
Figure 2:
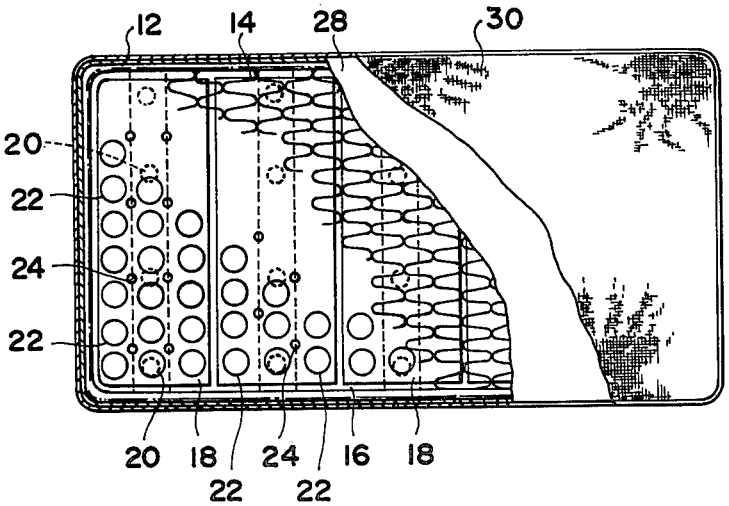
FIG. 2 is a partially cutaway plan view thereof.

Before description of embodiments, an explanation is given below about the principle of the present invention with reference to FIGS. 1 and 2.

Positioned above base bed frames (10) is a peripheral rectangular frame (12), within which are mounted a large number of snake springs (14) to form a bed surface (A). Fixed transversely between the base frames (10) are supporting frames (16). Between the supporting frames (16) and the snake springs (14) are supported a plural number of longitudinally divided movable bottom plates (18) of the bed through lifting mechanisms (20) attached to the supporting frames (16) so that the bottom plates (18) are vertically movable and their positions can be fixed. Furthermore, a large number of coiled springs (22) are elastically mounted upright and close together between the movable bottom plates (18) and the snake springs (14). In the movable bottom plates (18) are formed small holes (24), through which are inserted connecting strings (26), one ends of which are connected to the snake springs (14) and the opposite ends to the supporting frames (16), so that the bed surface (A) is maintained flat above the supporting frames (16). The snake springs (14) are covered with a bed cover sheet member (30) through a heat retaining buffer layer (28) such as a sponge sheet.

In the bed constructed as above, the lifting mechanisms (20) are actuated to move the bottom plates (18) parallelly in the vertical direction, thereby changing the compression of the coiled springs (22), that is, changing the urging force of those springs against the bed surface (A). For example, if the movable bottom plate (18) located in the position corresponding to the hip of the user is set higher and that located in the position corresponding to the leg portion is set lower respectively than the other portions, it becomes possible to bear flat each portion of a human body without depression of the hip. In case the bed is used in different directions or used by users of different physical constitutions, the lifting mechanisms (20) are operated to change the pressure distribution of the bed surface and obtain compressive forces of the coiled springs (22) suited to the user.

The principle of the present invention has been explained above. Now, embodiments of the lifting mechanism (20) are described below.

Figure 3:
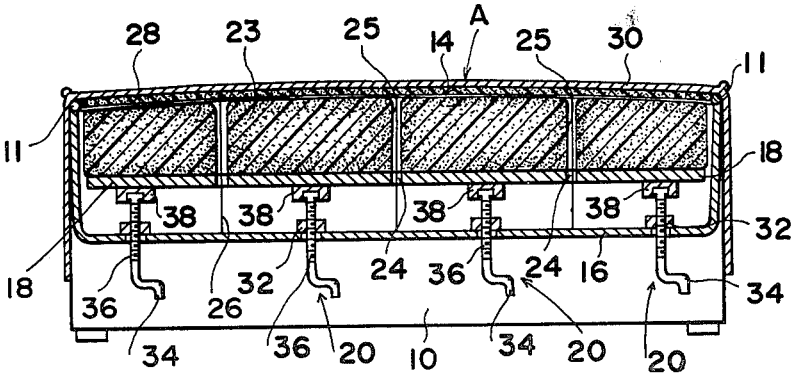
FIG. 3 is a longitudinal section in the direction of an end of the bed showing a first embodiment of a lifting mechanism.

FIG. 3 illustrates a lifting mechanism which utilizes the action of a threaded engagement and in which an elastic resin layer formed of example polyurethane is used as an elastic material. Between the side frames of a peripheral rectangular frame (11) are fixed supporting frames (16) transversely in a suitably spaced manner. Also mounted between the said side frames are corrugated linear snake springs (14), which form a bed surface (A). The reference numeral (18) is a bottom plate positioned between the supporting frame (16) and the snake springs (14). The bottom plate (18) is movable and is provided in plural numbers which are divided in the longitudinal direction, and it is carried through bearing seats (38) on the end portions of bolts (36) of lifting mechanisms (20), each of which consists of a nut (32) fixed to the supporting frames (16) and the bolt (36) having a crank-shaped turning handle (34), the bolt (36) being threadedly engaged with the nut (32). The movable bottom plates (18) are moved vertically in parallel by the lifting mechanisms (20). The numeral (23) is an elastic resin layer of a foamed material such as polyurethane resin interposed between the bottom plate (18) and the snake springs (14). In the elastic resin layer (23) and bottom plates (18) are formed small holes (25)(24), through which are inserted connecting strings (26), one ends of which are connected to the snake springs (14) and the opposite ends to the supporting frames (2), so that the plane shape formed by the snake springs (14) is tensionally maintained. The numeral (10) is a base frame of the bed and the numeral (30) is a cover sheet. Between the cover sheet (30) and the snake springs (14) is interposed a buffer sheet (28) made of a foamed resin or the like.

When using the bed of the above construction, the lifting mechanisms (20) are operated to produce a vertical movement, as has been explained in the paragraph concerning the principle of the present invention; that is, the handle (34) is turned to advance or retreat the bolt (36) by a threaded engagement of the bolt (36) with the nut (32), resulting in that the bottom plates (18) are moved parallelly in the vertical direction and the elastic resin layer (23) is partially urged from below, and thus the internal stress is changed in various positions of the elastic resin layer (23), while the bed surface (A) is maintained flat by the connecting strings (26).

Figure 4:
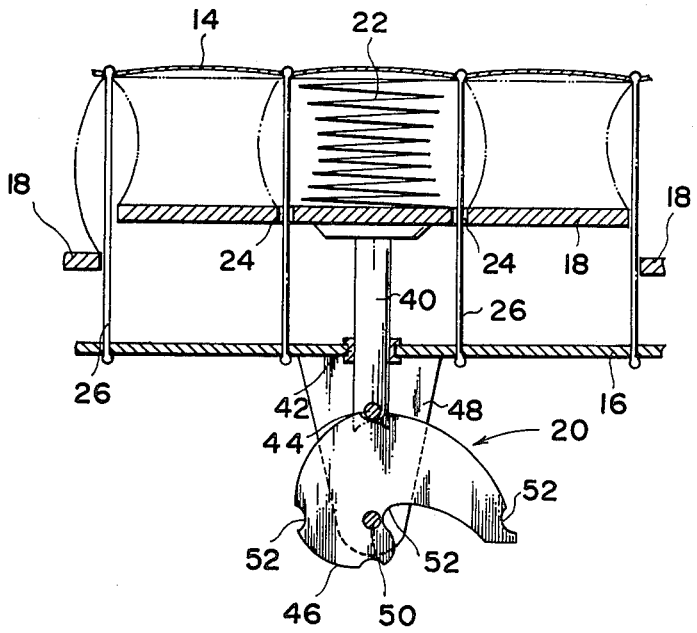
FIG. 4 is a sectional front elevation of main part showing a second embodiment of a lifting mechanism.
Figure 5:
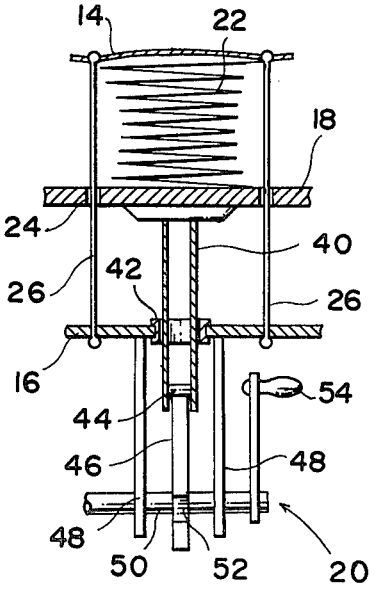
FIG. 5 is a right side view of FIG. 4.

Referring now to FIGS. 4 and 5 to illustrate a second embodiment of the lifting mechanism (20), the reference numeral (22) is a coiled spring interposed between the snake springs (14) and the movable plate (18). The coiled spring (22) is provided in plural numbers which are mounted upright and close together, lengthwise and crosswise. Mounted upright on the lower surface of the movable bottom plate (18) is a sliding rod (40), which passes slidably through an insertion member (42) mounted in the supporting frame (16) and projects from the lower surface of the supporting frame (16), with the end portion of the sliding rod (40) being provided with an abutting member (44) which is in abutment with a cam (46). The cam (46) is mounted on a pivot shaft (50) which is journaled in brackets (48) projecting from the lower surface of the supporting frame (16). The cam face forms a whirlpool and is provided in suitable positions with shallow recesses (52) in which fits the abutting member (44). The pivot shaft (50) extends in the transverse direction of the bed and also pivots other cams (46) simultaneously which are positioned in the same row. To the end portion of the pivot shaft (50) is attached a turning handle (54) which is in the form of a crank.

In the lifting mechanism (20) constructed as above, the handle (54) is turned to pivot the cam (46) through the pivot shaft (50), so that the abutting position of the sliding rod (40) is changed and the movable plate (18) is raised or lowered. When the abutting member (44) fits in any of the recess (52) of the cam (46), the sliding rod (40) is retained stably in that position.

Figure 6:
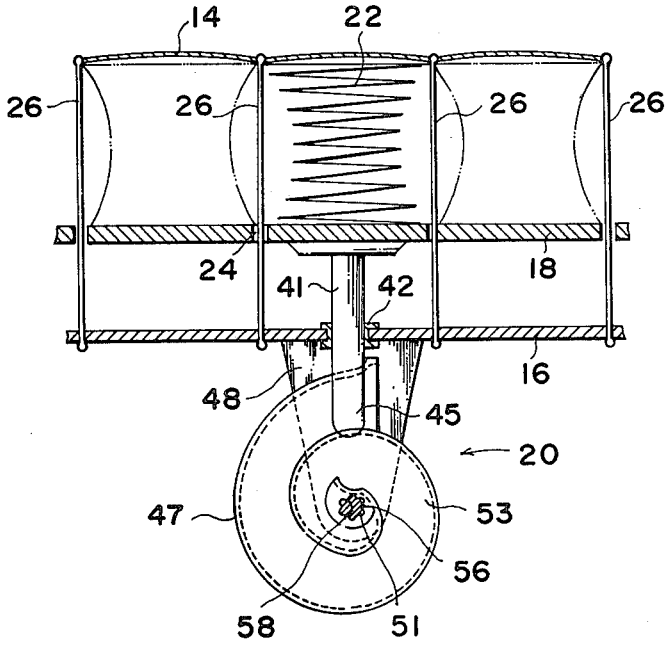
FIG. 6 is a sectional front elevation of main part showing a third embodiment of a lifting mechanism.
Figure 7:
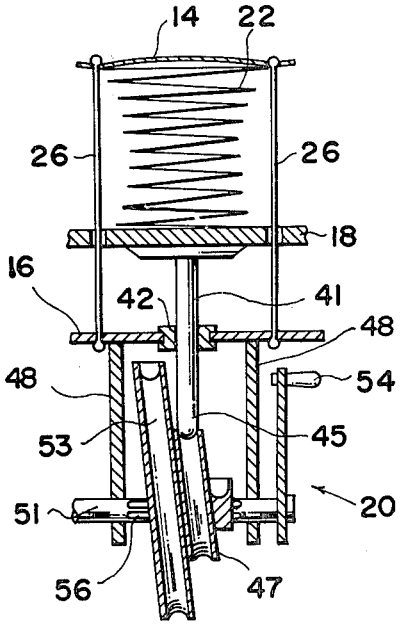
FIG. 7 is a right side view of FIG. 6.
Figure 8:
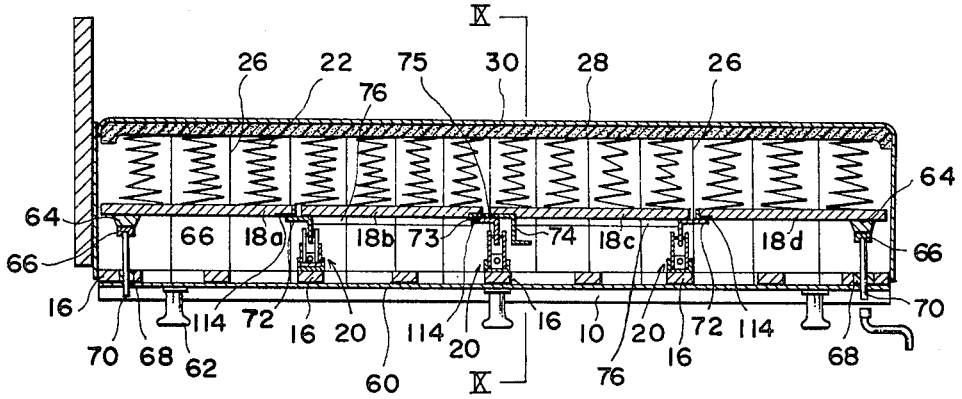
FIG. 8 is a longitudinal side section of a bed provided with other lifting mechanism.
Figure 9:
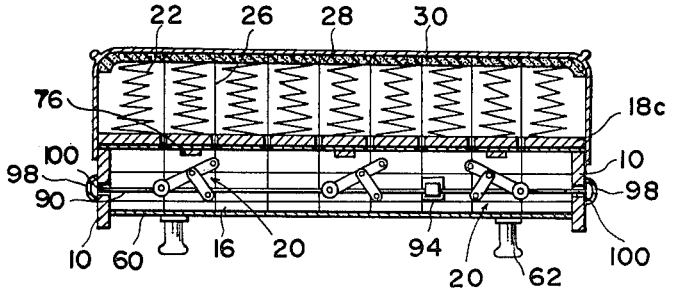
FIG. 9 is a view taken on the line IX—IX of FIG. 8.

Referring now to FIGS. 6 and 7 which illustrate a third embodiment of the lifting mechanism (20), the reference numeral (41) is a sliding rod mounted upright on the lower surface of the movable plate (18), which sliding rod (41) passes slidably through the insertion member (42) mounted in the supporting frame (16) and projects from the lower surface of the supporting frame (16), with the lower end of the sliding rod (41) being in abutment with a cam (47). The cam (47) has a snail-shaped cam face (53) and also has a spline hole (58), which is fitted over a spline wheel (56) mounted on a pivot shaft (51) to thereby prevent a pivotal movement while permitting a sliding motion. The pivot shaft (51) is journaled slidably in brackets (48) projecting from the lower surface of the supporting frame (16) and extends in the transverse direction of the bed, and it also pivots other cams (47) simultaneously which are positioned in the same row. To the end portion of the pivot shaft (51) is attached the crank-shaped turning handle (54).

In the lifting mechanism (20) of the above construction, the handle (54) is turned to rotate the cam (47) through the pivot shaft (51), so that the sliding rod (41) which is in abutment at its lower end (45) with the snail-shaped cam face (53) slides and the movable plate (18) is forced up or down. During such rotation of the cam (47), the abutting position of the sliding rod (41) does not come off the cam face (53) because of an axial sliding of the spline wheel (56) and the spline hole (58).

Figure 10:
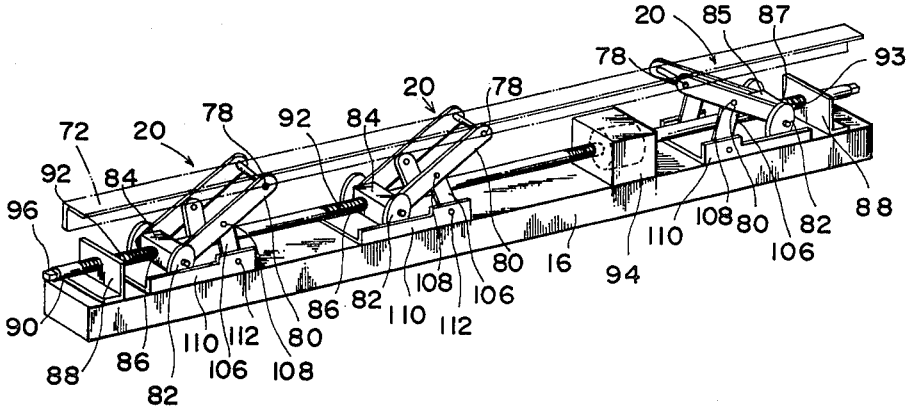
FIG. 10 is a perspective view of the said lifting mechanism.
Figure 11:
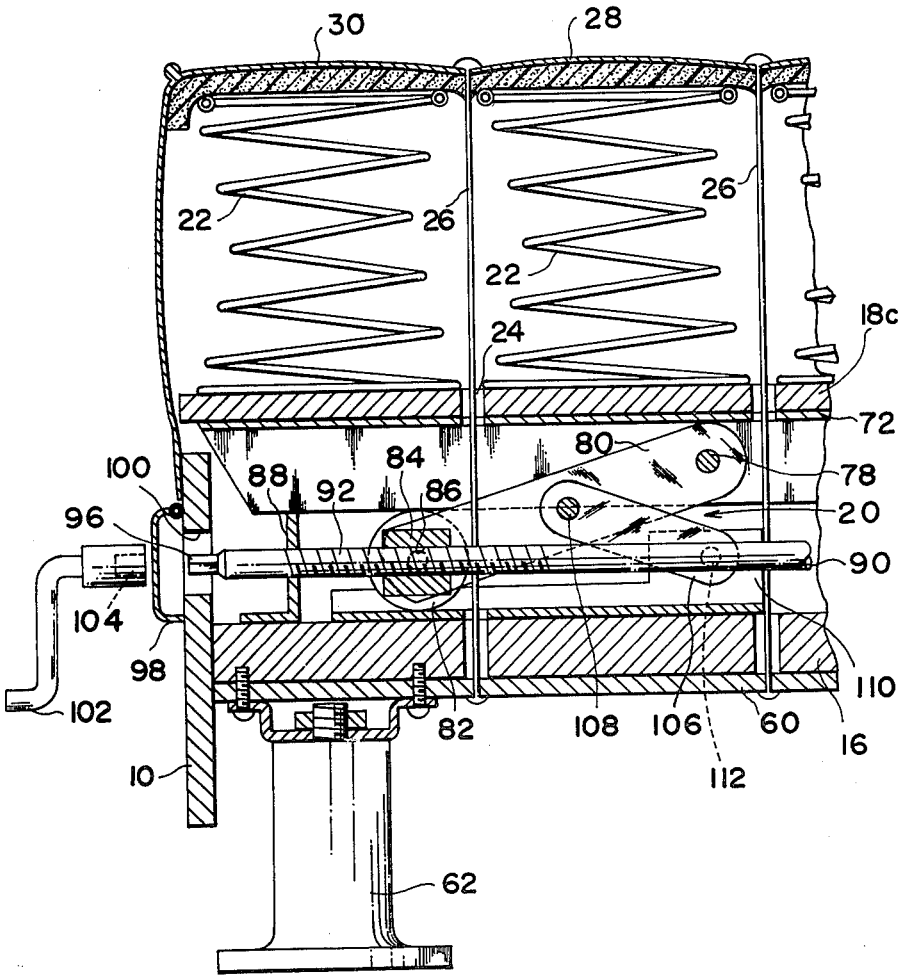
FIG. 11 is an enlarged section of main part of the bed.

Referring now to FIGS. 8 through 11 which illustrate another embodiment of the bed and its lifting mechanism (20) of the present invention, the reference numeral (10) represents base frames of the bed which run parallel with each other with respect to the floor surface. The supporting frames (16) are mounted side by side between the base frames (10), and on the lower faces of the supporting frames (16) is mounted a cover plate (60), which is kept floated from the floor surface by means of legs (62). Above the cover plate (60) are mounted four longitudinally divided bottom plates (18*a*)(18*b*)(18*c*)(18*d*), and a reinforcing member (64) is rigidly attached to the lower face of the outer end portion of each of the end bottom plates (18*a*)(18*d*). And further attached to the reinforcing member (64) is a catch (66), in which loosely fits the upper end portion of a bolt (70) which is threadedly engaged with a nut (68), the nut (68) being buried in the supporting frame (16). Thus, the end bottom plates (18*a*)(18*d*) are supported above the supporting frames (16) through the bolts (70). To one ends of the inside bottom plates (18*b*)(18*c*) are rigidly attached connecting angle members (72), at side ends of which are retained the adjacent bottom plates (18*a*)(18*d*). To the other end of the inside bottom plate (18*c*) is fixed a reinforcing member (74), and to a retaining end (75) of the reinforcing member (74) is retained a side end of a connecting angle member (73) which is secured to the other end of the opposed bottom plate (18*b*), and thus the bottom plates are connected together. Between the connecting members (72)(73) and the supporting frames (16) are interposed the lifting mechanisms (20) to support the bottom plates (18*a*)(18*b*)(18*c*)(18*d*) in a vertically adjustable manner. The reference numeral (76) is a reinforcing member provided in the longitudinal direction of the bottom plates (18*b*)(18*c*). Above the bottom plates (18*a*)(18*b*)(18*c*)(18*d*) are mounted upright and close together a large number of coiled springs (22), the upper ends of which are connected together to form a plane and are covered with the cover member for bed (30) through the sheet member (28) such as a foamed resin. Between the cover member (30) and the foregoing cover plate (60) are provided the clamping strings (26) of an equal length which extend through the small holes (24) of the bottom plates (18*a*)(18*b*)(18*c*)(18*d*), so that the bed surface is maintained parallel to the cover plate (60). As shown in FIGS. 10 and 11, the lifting mechanism (20) consists of lever members (80), one ends of which are pivoted for rocking motion to the conecting member (72) or (73) through a pin (78), and to the other ends are attached axles (84)(85) in which are pivotably journaled rollers (82). The axles (84)(85) are provided centrally with tapped holes (86)(87) which intersect the axles at right angles. With the tapped holes (86)(87), which are threaded with the same pitch, are threadedly engaged external threads (92) (93) of a threaded shaft (90) which is journaled in brackets (88) near the end portions. The threaded shaft (90) is further journaled in a beariing (94) which is fixed to the supporting frame (16). Under such construction, the threaded shaft (90) is allowed to rotate without sliding in the axial direction. Both ends of the threaded shaft (90) are in the form of a square shaft (96), which is engageable with a square hole (104) of a crank handle (102), the crank handle (102) being inserted from a handle opening (100) which is provided with a cover (98) designed to permit opening and closing. The reference numeral (106) is a supporting rod, one end of which is pivotably secured to the center of the lever member (80) through a pin (108), and the other end is pivoted through a pin (112) to a bracket (110) which is fixed to the supporting frame (16). The supporting rod (106) has a length half as much as the lever member (80). In the junctions of the bottom plates (18*a*)(18*b*)(18*c*)(18*d*) are provided a sound absorbing material (114) to prevent creak or like sounds.

When using the bed of the above construction, the handle (102) is inserted from the handle opening (100) and is fitted over the square shaft (96) of the threaded shaft (90), then is turned to operate the lifting mechanisms (20) thereby raising the bottom plates (18*a*)(18*b*)(18*c*)(18*d*) and compressing to a desired extent the coiled springs (22) interposed between the said bottom plates and the cover member (30), to obtain an increased internal pressure. In this case, the clamping strings (26) provided between the cover member (30) and the foregoing cover plate (60) prevent the resilience of the coiled springs (22) from expanding the bed surface in the form of a crown. In the lifting mechanism (20) construction as above, rotation of the threaded shaft (90) generates the action of a threaded engagement between the external threads (92)(93) and the tapped holes (86) (87) of the axles (84)(85), resulting in that the rollers (82) rotate on the brackets (110), which causes the lever member (80) to change its tilting angle with respect to the connecting members (72)(73) with the pin (78) as a fulcrum, that is, the height from the supporting frame (16) is changed. Since the supporting rod (106) is of a half length of the lever member (80), the roller (82) rotates without floating from the bracket (110), allowing a vertical movement to be generated. In addition, since the tapped holes (86)(87) are of the same pitch and in opposite direction, the lever members (80) are raised or lowered in a parallel manner. Furthermore, the end bottom plates (18*a*)(18*d*) can be forced up or down at end portions thereof by turning the bolts (70) which are mounted in the supporting frames (16) positioned at both ends. Usually, therefore, if the central bottom plates (18*b*)(18*c*) are set so as to be slightly higher than the other bottom plates according to the physical constitution, etc. of the user, the central portion of the bed presents a higher surface pressure than in the other portion of the bed, so that a human body can be borne flat and a posture for comfortable sleep can be formed. Furthermore, even when years of use of the bed has caused deterioration of the coiled springs, etc. and the bed has become liable to be depressed, it is possible make correction of elasticity by raising the bottom plate located in the corresponding position, and besides the hardness throughout the bed surface can be adjusted.

In the bed of the present invention, as set forth hereinbefore, with only operation of the lifting mechanism the internal pressure of various portions of the mattress is adjusted whereby the hardness and its distribution of the bed surface can be changed easily according to the user's desire, and consequently a comfortable sleep is assured. In addition, the deterioration of elastic materials can be remedied externally, thus permitting a long period of use. Thus, the bed of the present invention is very useful.

Furthermore, the lifting mechanism shown in the foregoing embodiments are all of a simple construction based on a fundamental principle of operation, so they are very easy to handle and afford a sufficient strength.

As will be seen from the foregoing embodiments, it is apparent that various changes and modifications may be made without departing from the principle of the present invention. Therefore, it is intended to cover in the appended claims all such changes and modifications as substantially afford the effects of the present invention by the use of a construction substantially same as or falling within the scope of the invention.

What is claimed is:

1. An internal pressure-adjustable bed comprising:
a plurality of base plates arranged longitudinally of the bed and extending transversely between the sides thereof, each of said base plates being individually movable vertically;
a resilient mattress carried on said base plates;
means for constraining the upper surface of said mattress to maintan same in a substantially horizontal disposition;
and means for effecting selective vertical movement of said base plates to thereby enable selective longitudinal regulation of the internal pressure of said resilient mattress.

2. The bed as defined in claim 1, in which said resilient mattress comprises a plurality of coil springs.

3. The bed as defined in claim 1, in which said resilient mattress comprises an elastic resin layer.

4. The bed as defined in claim 1, comprising a base frame positioned beneath said base plates and a plurality of clamping string-like elements connected between horizontally-spaced locations of said upper surface of the mattress and said base frame, whereby the upper surface of said mattress is constrained to maintain a substantially horizontal disposition independently of the vertical movement of said base plates.

5. The bed as defined in claim 1, in which said base plates are connected together so as to permit bending of the respective adjacent sides.

6. The bed as defined in claim 4, in which said means for effecting selective vertical movement of said base plates includes an externally threaded vertical shaft, an internally threaded member fixed to the base frame of the bed and adapted to threadedly receive said vertical shaft, the upper end of said externally threaded shaft supporting each said base plate, whereby threaded movement of said externally threaded shaft effects vertical movement of each said base plate.

7. The bed as defined in claim 2, in which said means for effecting selective vertical movement of said base plates includes cam means having a generally spiral cam face, said cam means being pivotably secured to a part of the base frame, and slidable rods which are in abutment with said cam face and which are attached to respective ones of said movable base plates so as to project therefrom, said movable base plates supporting said coiled springs from below.

8. The bed as defined in claim 4, in which said means for effecting selective vertical movement of said base plates includes cam means having a cam face which is in the general form of a worm gear, said cam means being pivoted to a pivot shaft so as to be axially slidable thereon while being prevented from rotation, said pivot shaft being journaled in part of the base frame, and slidable rods which are in abutment with said cam face and which are attached to respective ones of said movable base plates so as to project therefrom.

9. The bed as defined in claim 4, in which said means for effecting selective vertical movement of said base plates includes lever members interposed between said base plates and the base frame of the bed, said lever members being adapted to pivot about one end thereof by the action of a threaded shaft cooperating therewith to thereby change their angles of tilt.

10. The bed as defined in claim 9, in which said threaded shaft extends to the sides of the bed and is covered at the ends thereof with a cover capable of being opened and closed, said cover being provided on the sides of the bed, and further including a handle which is adapted to be inserted in an opened condition of said cover to be engaged with said threaded shaft for the turning of same.

* * * * *